US011040434B1

(12) United States Patent
Werner

(10) Patent No.: US 11,040,434 B1
(45) Date of Patent: Jun. 22, 2021

(54) ADJUSTABLE DUAL-RANGE WRENCH

(71) Applicant: Gary Werner, Lakewood, CO (US)

(72) Inventor: Gary Werner, Lakewood, CO (US)

( * ) Notice: Subject to any disclaimer, the term of this patent is extended or adjusted under 35 U.S.C. 154(b) by 0 days.

(21) Appl. No.: 16/999,736

(22) Filed: Aug. 21, 2020

(51) Int. Cl.
*B25B 13/50* (2006.01)
*B25B 13/32* (2006.01)

(52) U.S. Cl.
CPC ..... *B25B 13/505* (2013.01); *B25B 13/32* (2013.01); *B25B 13/5058* (2013.01)

(58) Field of Classification Search
CPC ..... B25B 13/505; B25B 13/14; B25B 13/32; B25B 13/5058
USPC ..... 81/90.9, 97, 99, 179
See application file for complete search history.

(56) References Cited

U.S. PATENT DOCUMENTS 707,895 A * 8/1902 Barnes ..... B25B 13/14 81/127
1,207,334 A * 12/1916 Shostrom ..... B25B 13/14 81/107
1,672,804 A * 6/1928 Conrad ..... B25B 13/107 81/186
2,558,440 A * 6/1951 Johnson ..... B25B 7/10 81/412
7,546,784 B1 * 6/2009 Yu ..... B25B 13/28 81/111
7,882,768 B2 * 2/2011 Urquizu Osa ..... B25B 13/28 81/99
2014/0326109 A1 * 11/2014 Ma ..... B25B 13/16 81/166

* cited by examiner

*Primary Examiner* — Joseph J Hail
*Assistant Examiner* — J Stephen Taylor
(74) *Attorney, Agent, or Firm* — Perkins Coie LLP

(57) ABSTRACT

An adjustable dual-range wrench including an elongate handle and a fixed jaw carried by the handle. The fixed jaw includes multiple teeth disposed linearly along the jaw. A hook jaw is pivotably coupled to the handle opposite the fixed jaw. A toothed lobe is adjustably positioned along the fixed jaw between an outer engagement region sized to engage a first range of sizes and an inner engagement region sized to engage a second range of sizes. The hook jaw comprises a first set of teeth associated with the outer engagement region and a second set of teeth associated with the inner engagement region.

16 Claims, 6 Drawing Sheets

ADJUSTABLE DUAL-RANGE WRENCH

TECHNICAL FIELD

This patent application is directed to hand tools, and more specifically, to adjustable wrenches.

BACKGROUND

A pipe wrench is an adjustable wrench with multiple teeth on its upper and lower jaws. Pipe wrenches are designed to bite into the surface of metal pipe, for example, in order to turn the pipe for assembly or disassembly. Typically, pipe wrenches are adjusted by turning a thumb wheel that moves a hook jaw closer to or further away from a fixed jaw. Adjusting this type of wrench between large and small pipe diameters can be time consuming. Furthermore, pipe wrenches may not be as effective at gripping smaller diameters.

BRIEF DESCRIPTION OF THE DRAWINGS

The adjustable dual-range wrenches described herein may be better understood by referring to the following Detailed Description in conjunction with the accompanying drawings, in which like reference numerals indicate identical or functionally similar elements.

Figure 1:
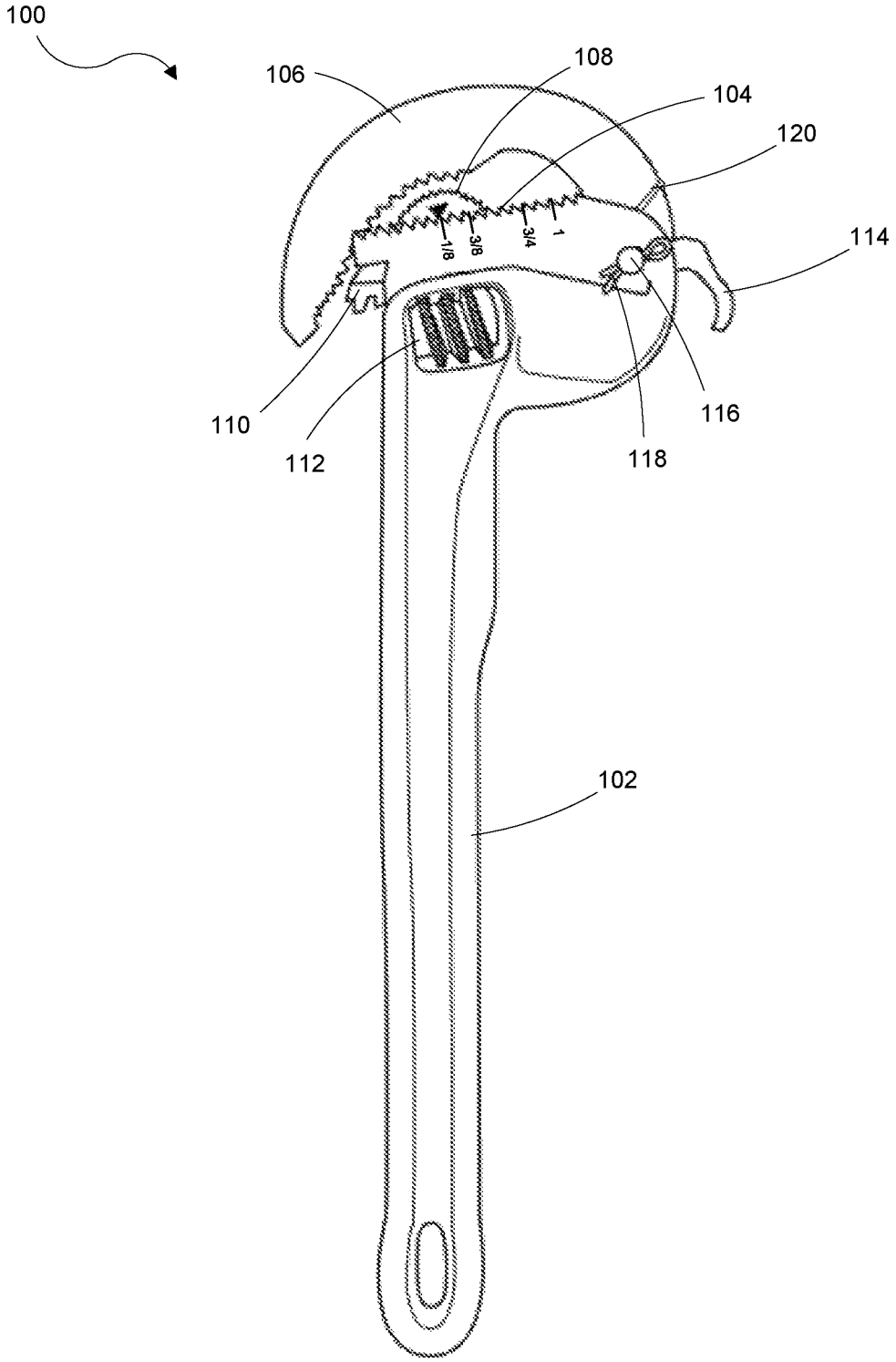
FIG. 1 is a side view of an adjustable dual-range wrench according to a representative embodiment.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all modifications, combinations, equivalents, and alternatives falling within the scope of this disclosure.

DETAILED DESCRIPTION

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

FIG. 1 illustrates an adjustable dual-range wrench 100 configured in accordance with a representative embodiment of the disclosed technology. The wrench 100 can include an elongate handle 102, a fixed jaw 104 carried by the handle 102, and a hook jaw 106 pivotably coupled to the handle 102. An adjustable lobe 108 is positioned along the fixed jaw 104. In some embodiments, the lobe 108 comprises a multi-toothed semi-circular element disposed on a gear rack 110. The lobe 108 can be adjustable along the fixed jaw 104 via a worm screw 112 engaged with the gear rack 110. The fixed jaw 104 can be integrally formed with the handle 102, or alternatively, the fixed jaw 104 can be comprised of a separate element that is fastened to the handle 102.

The hook jaw 106 can be pivotably coupled to the handle with a pivot pin 116 which is retained in position with a cotter pin 118, for example. In some embodiments, a spring element, such as a double torsion spring 120, is positioned to bias the hook jaw 106 toward the fixed jaw 104. A thumb lever 114 extends from the hook jaw 106 to facilitate pivoting the hook jaw 106 against the spring 120 and away from the fixed jaw 104 to engage a pipe or other item to be rotated with the wrench.

Figure 2:
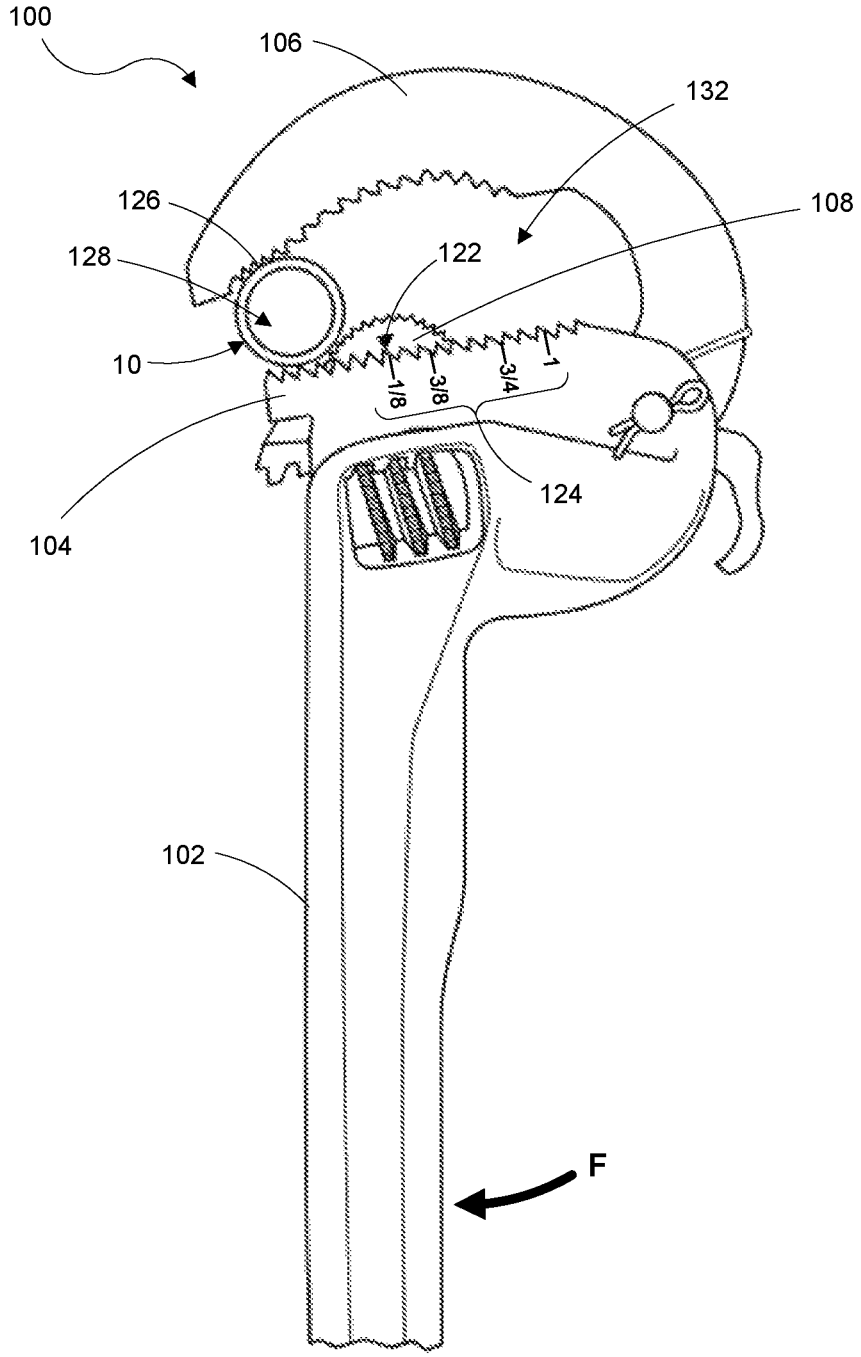
FIG. 2 is a side view of the wrench shown in FIG. 1 engaging a pipe positioned in an outer engagement region of the wrench.

With reference to FIG. 2, the lobe 108 can be positioned between an outer engagement region 128 sized to engage a first range of sizes (e.g., pipe sizes) and an inner engagement region 132 sized to engage a second range of sizes. In the depicted embodiment, the outer engagement region 128 is configured to engage a smaller range of pipe than the inner engagement region 132. For example, in FIG. 2 the wrench 100 is gripping a section of ⅛ inch pipe 10 between the hook jaw 106, an outer portion of the fixed jaw 104, and the lobe 108. In some embodiments, the hook jaw 106 comprises a first set of teeth 126 associated with the outer engagement region 128. The first set of teeth 126 can have a relatively small pitch to facilitate engaging smaller diameter items.

In some embodiments, the wrench 100 can include first indicia 124 positioned proximate the fixed jaw 104 on a first side of the wrench indicating lobe positions corresponding to selected sizes in the first range. For example, indicia 124 includes lobe position markings indicating lobe positions for ⅛, ⅜, ¾, and 1 inch pipe. In some embodiments, the lobe 108 can include a position indicator 122 to facilitate aligning the lobe with a corresponding size. Although, the ranges and markings are described herein with respect to schedule 40 pipe sizes, other size units and increments can be used, such as inches or millimeters. Furthermore, the wrench 100 is suitable for gripping and rotating other items besides pipe, such as nuts and bolts.

Figure 3:
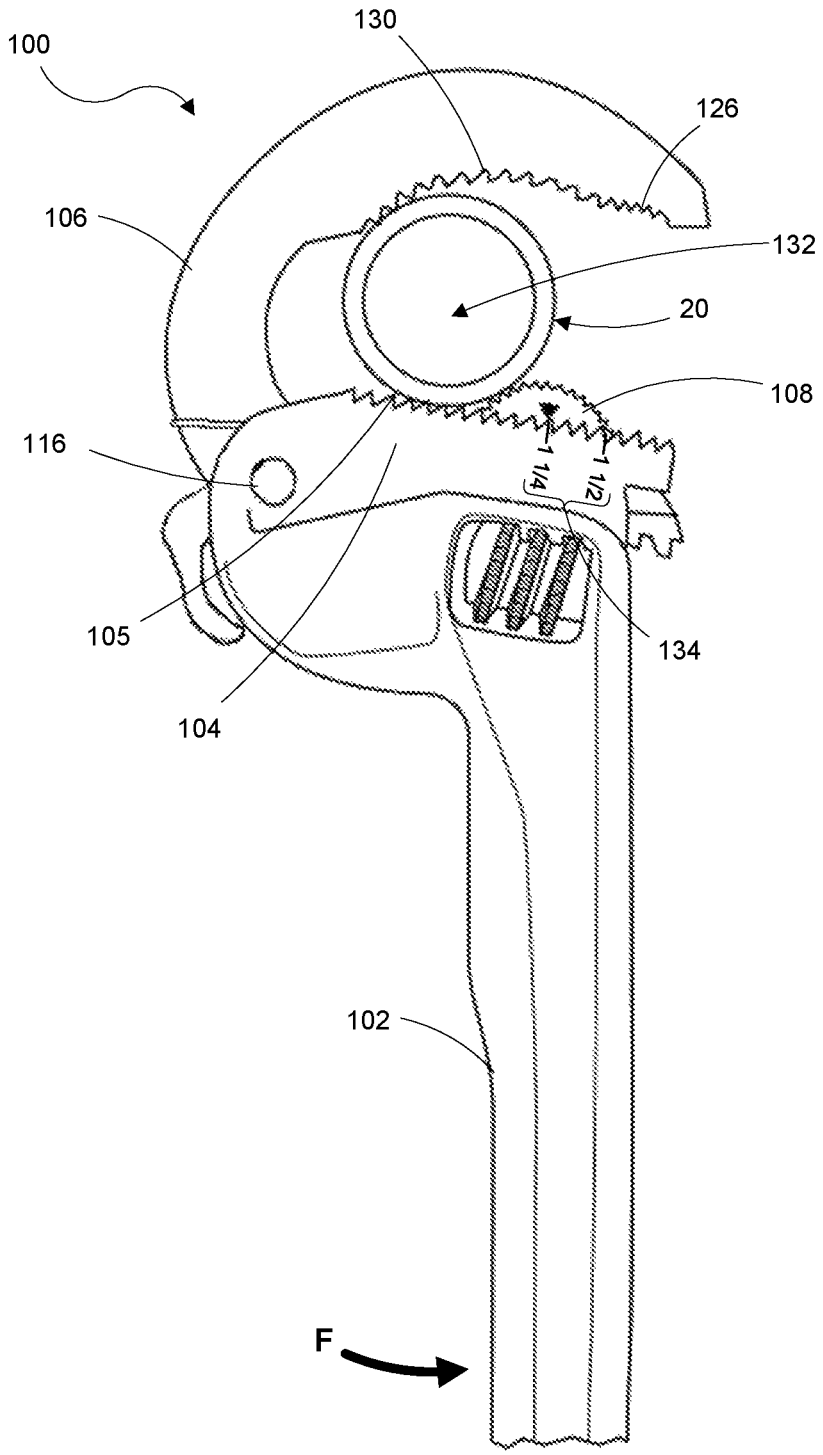
FIG. 3 is an opposite side view of the wrench shown in FIGS. 1 and 2 engaging a pipe positioned in an inner engagement region of the wrench.

As shown in FIG. 3, the wrench 100 can also include second indicia 134 positioned proximate the fixed jaw 104 on a second, opposite, side of the wrench indicating lobe positions corresponding to selected sizes in the second range. For example, indicia 134 includes lobe position markings indicating lobe positions for 1¼ and 1½ inch pipe.

Continuing with FIG. 3, the wrench 100 is gripping a section of 1¼ inch pipe 20 between the hook jaw 106, an inner portion of the fixed jaw 104, and the lobe 108. In some embodiments, the hook jaw 106 comprises a second set of teeth 130 associated with the inner engagement region 132. As indicated above, the second set of teeth 130 can have a relatively large pitch to facilitate engaging larger diameter items. The teeth 126/130 disposed in the hook jaw 106 are generally angled toward the pivot pin 116 while the teeth 105 of the fixed jaw 104 are angled away from the pivot pin 116. In operation, the angle of the teeth tend to cause the teeth to bite into the pipe 20 as a force is applied to the wrench handle 102 as indicated by arrow F.

Figure 4:
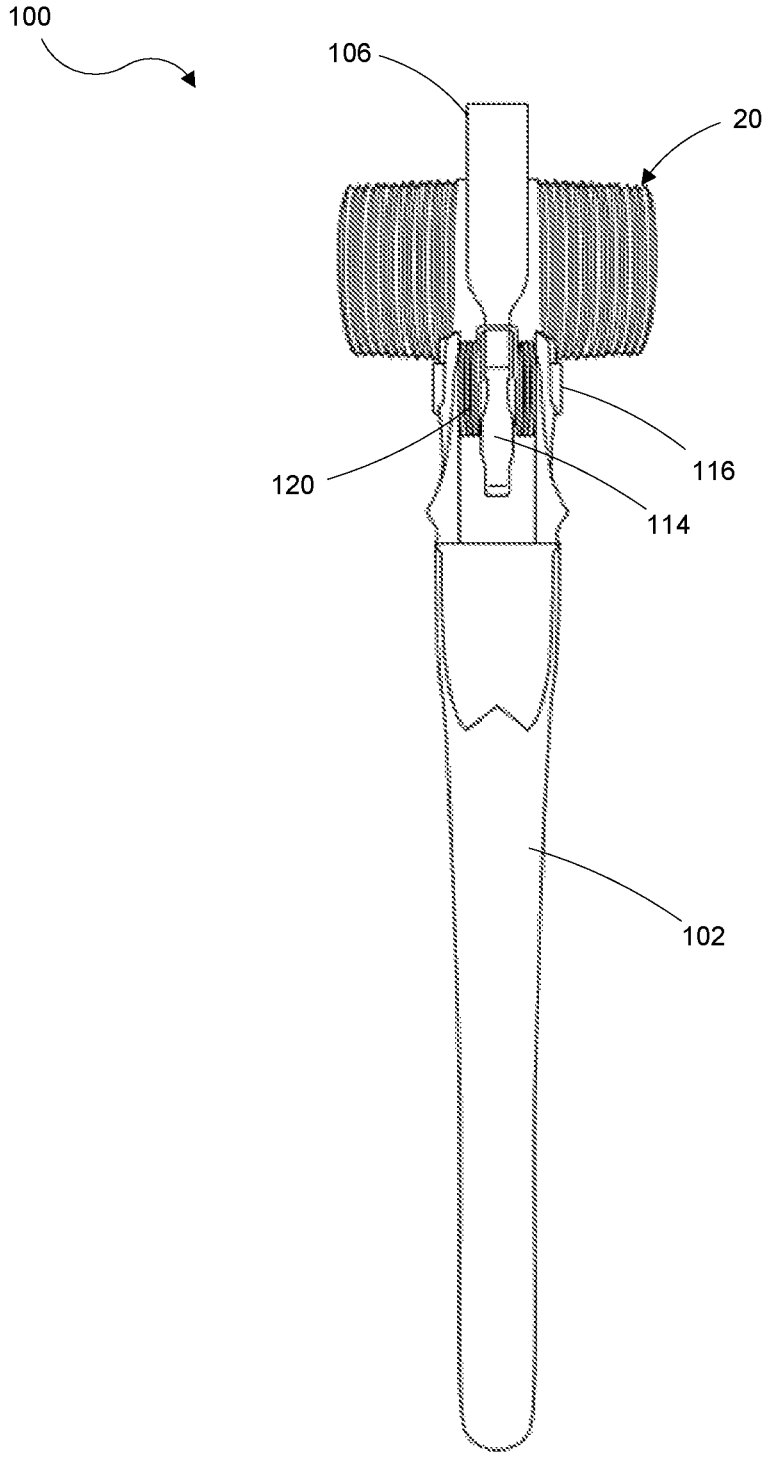
FIG. 4 is a back view of the wrench shown in FIGS. 1-3.
Figure 5:
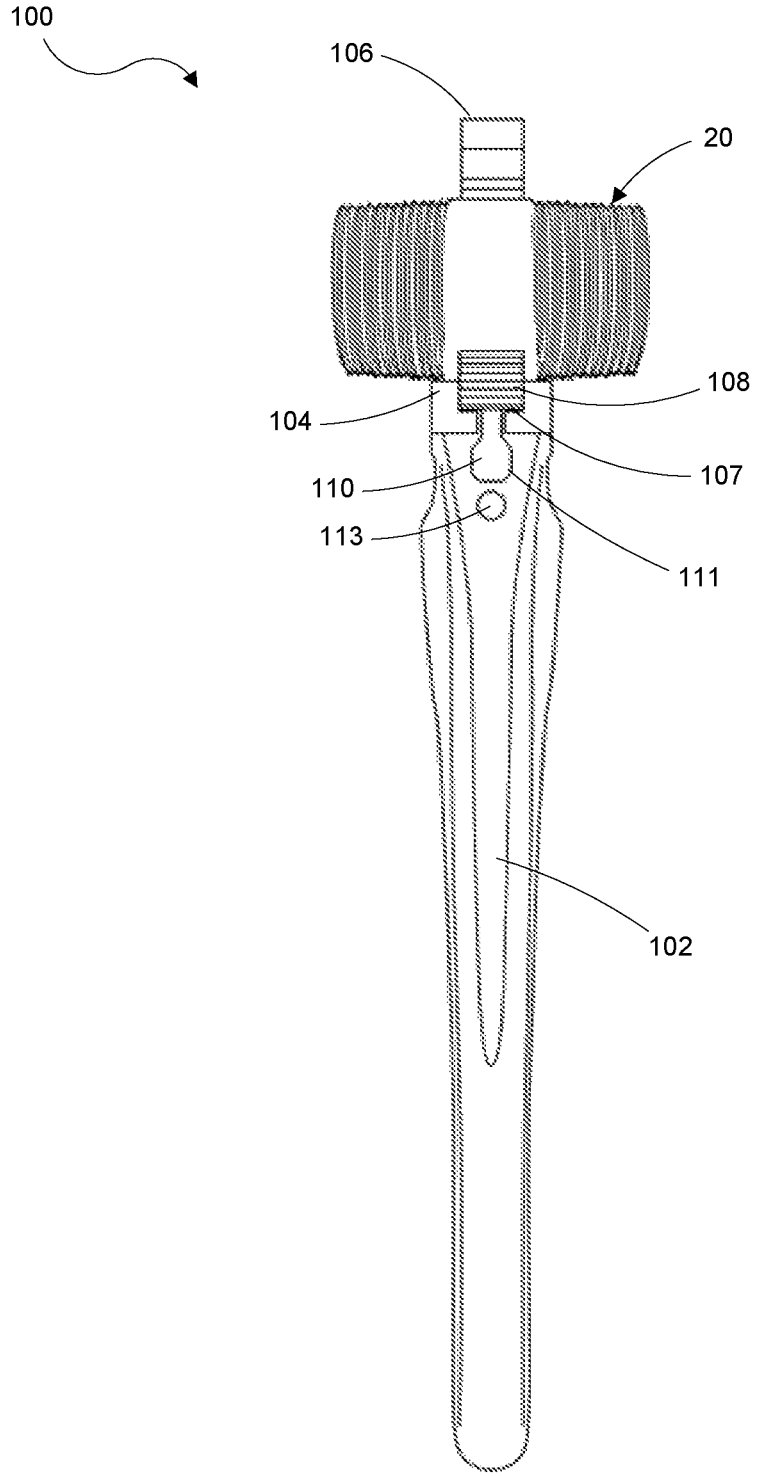
FIG. 5 is a front view of the wrench shown in FIGS. 1-4.
Figure 6:
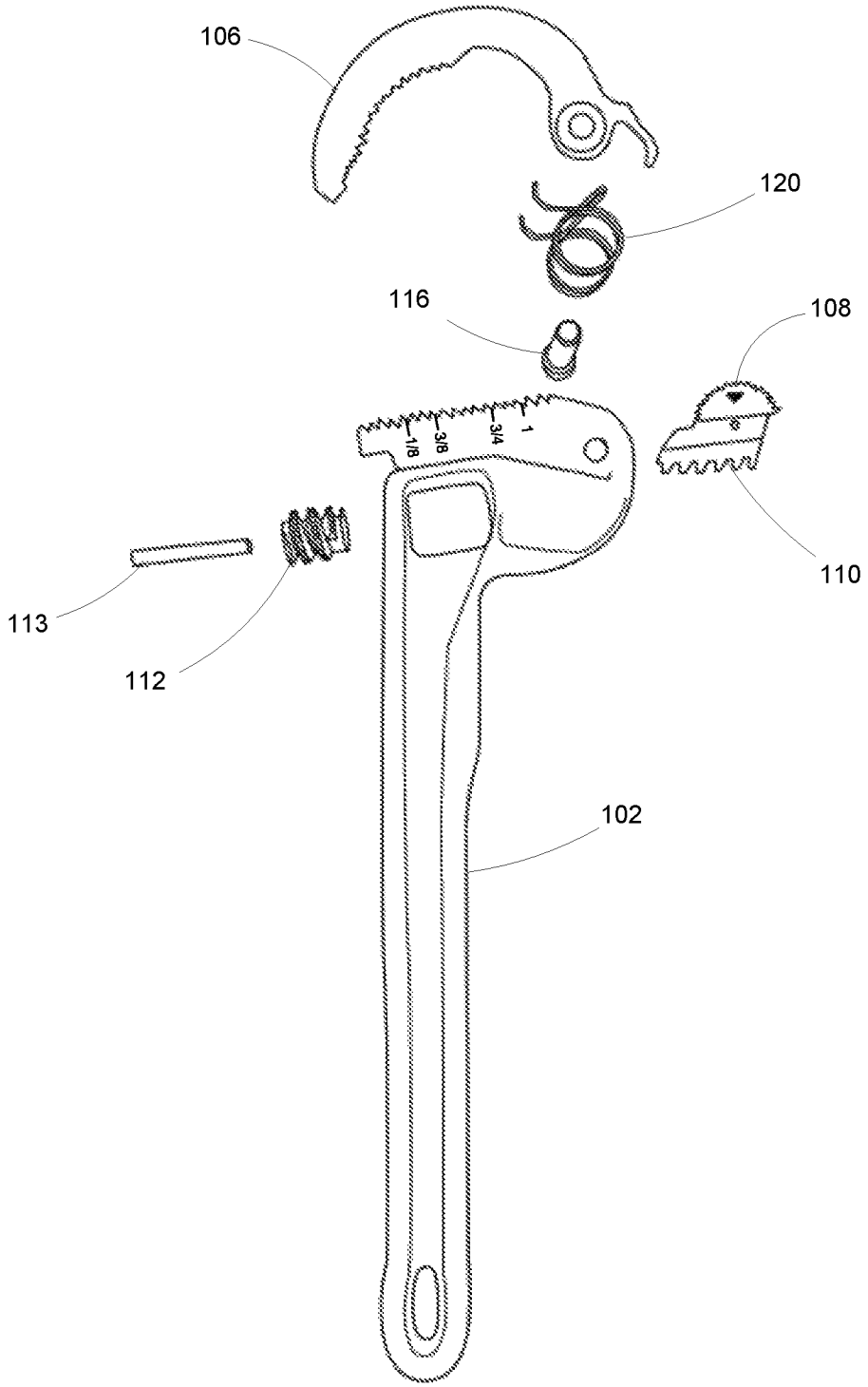
FIG. 6 is an exploded view of the wrench shown in FIGS. 1-5.

FIG. 4 is a back view of the wrench 100 further illustrating the location of various components. For example, the double torsion spring 120 is positioned around the pivot pin 116 between the handle 102 and the hook jaw 106. As shown in FIG. 5, the lobe 108 can slide in a channel 107 formed in the fixed jaw 104 and the gear rack 110 slides in an associated groove 111. In some embodiments, the worm screw 112 (FIGS. 1-3) is retained in the handle 102 with a bearing pin 113 that can be pressed or threaded into the handle, for example. FIG. 6 is an exploded view further illustrating the location and assembly of the various wrench components.

In representative embodiments of the disclosed technology, an adjustable wrench comprises an elongate handle, a fixed jaw carried by the handle, and a hook jaw pivotably coupled to the handle. In some embodiments, a lobe is adjustably positioned along the fixed jaw. In one aspect of the disclosed technology, the lobe comprises a multi-toothed semi-circular element disposed on a gear rack. The lobe being adjustable along the fixed jaw via a worm screw engaged with the gear rack. In another aspect of the disclosed technology, the wrench further comprises a spring element positioned to bias the hook jaw toward the fixed jaw. In further aspects of the disclosed technology, the fixed jaw comprises multiple teeth disposed linearly along the jaw. In some embodiments, the hook jaw comprises an arcuate portion with multiple teeth disposed thereon. In further embodiments, the lobe is positioned between an outer engagement region sized to engage a first range of sizes and an inner engagement region sized engage a second range of sizes. In yet another aspect of the disclosed technology, the wrench further comprises first indicia positioned proximate the fixed jaw on a first side of the wrench indicating lobe positions corresponding to selected sizes in the first range, and second indicia positioned proximate the fixed jaw on a second side of the wrench indicating lobe positions corresponding to selected sizes in the second range.

In representative embodiments of the disclosed technology, an adjustable dual-range wrench comprises an elongate handle, a fixed jaw carried by the handle, and a hook jaw pivotably coupled to the handle. In some embodiments, the fixed jaw comprises multiple teeth disposed linearly along the jaw. In some embodiments, a lobe is adjustably positioned along the fixed jaw, wherein the lobe is positioned between an outer engagement region sized to engage a first range of sizes and an inner engagement region sized to engage a second range of sizes. In some embodiments, the hook jaw comprises a first set of teeth associated with the outer engagement region and a second set of teeth associated with the inner engagement region. In one aspect of the disclosed technology, the lobe comprises a multi-toothed semi-circular element disposed on a gear rack, said lobe being adjustable along the fixed jaw via a worm screw engaged with the gear rack. In some embodiments, the wrench further comprises a spring element positioned to bias the hook jaw toward the fixed jaw. In another aspect of the disclosed technology, the wrench further comprises first indicia positioned proximate the fixed jaw on a first side of the wrench indicating lobe positions corresponding to selected sizes in the first range, and second indicia positioned proximate the fixed jaw on a second side of the wrench indicating lobe positions corresponding to selected sizes in the second range. In some embodiments, the first set of teeth have a first pitch and the second set of teeth have a second pitch larger than the first. In some embodiments, the first range of sizes corresponds to ⅛ to 1 inch pipe and the second range of sizes corresponds to 1 to 1½ inch pipe. In some embodiments, the first range of sizes corresponds to ⅛ to 1 inch pipe and the second range of sizes corresponds to 1 to 1½ inch pipe (e.g., schedule 40 pipe). In some embodiments, the first range of sizes corresponds to approximately 0.405 inches to approximately 1.315 inches and the second range of sizes corresponds to approximately 1.315 inches to approximately 1.9 inches. In some embodiments, the second range of sizes corresponds to approximately 1.66 inches to approximately 1.9 inches.

In representative embodiments of the disclosed technology, a dual-range wrench comprises an elongate handle, a fixed jaw carried by the handle, and a hook jaw coupled to the handle with a pivot pin. In some embodiments, the fixed jaw comprises multiple teeth disposed linearly along the jaw and the hook jaw includes multiple teeth angled toward the pivot pin. In some embodiments, a lobe is positioned adjacent the fixed jaw, wherein the lobe is positioned between an outer engagement region sized to engage a first range of sizes and an inner engagement region sized to engage a second range of sizes. In some embodiments, the multiple hook jaw teeth comprise a first set of teeth associated with the outer engagement region and a second set of teeth associated with the inner engagement region. In some embodiments, the first set of teeth have a first pitch and the second set of teeth have a second pitch larger than the first. In some embodiments, the multiple fixed jaw teeth are angled away from the pivot pin. In some embodiments, the wrench further comprises a spring element positioned to bias the hook jaw toward the fixed jaw. In some embodiments, the lobe comprises a multi-toothed semi-circular element disposed on a gear rack, said lobe being adjustable along the fixed jaw via a worm screw engaged with the gear rack. In some embodiments, the wrench further comprises first indicia positioned proximate the fixed jaw on a first side of the wrench indicating lobe positions corresponding to selected sizes in the first range, and second indicia positioned proximate the fixed jaw on a second side of the wrench indicating lobe positions corresponding to selected sizes in the second range.

REMARKS

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. An adjustable wrench, comprising:

an elongate handle;

a fixed jaw carried by the handle;

a hook jaw pivotably coupled to the handle;

a lobe adjustable along the fixed jaw, said lobe positioned between an outer engagement region sized to engage a first range of sizes and an inner engagement region sized to engage a second rage of sizes; and first indicia positioned proximate the fixed jaw on a first side of the wrench indicating lobe positioned corresponding to selected sizes in the first range, and second indicia positioned proximate the fixed jaw on a second side of the wrench indicating lobe positions corresponding to selected sizes in the second range.

2. The wrench of claim 1, wherein the lobe comprises a multi-toothed semi-circular element disposed on a gear rack, said lobe being adjustable along the fixed jaw via a worm screw engaged with the gear rack.

3. The wrench of claim 1, further comprising a spring element positioned to bias the hook jaw toward the fixed jaw.

4. The wrench of claim 1, wherein the fixed jaw comprises multiple teeth disposed linearly along the jaw.

5. The wrench of claim 1, wherein the hook jaw comprises an arcuate portion with multiple teeth disposed thereon.

6. An adjustable dual-range wrench, comprising:

an elongate handle;

a fixed jaw carried by the handle, wherein the fixed jaw comprises multiple teeth disposed linearly along the jaw;

a hook jaw pivotably coupled to the handle; and a lobe positioned between an outer engagement region sized to engage a first range of sizes and an inner engagement region sized to engage a second range of sizes, said lobe comprising a multi-toothed semi-circular element disposed on a gear rack, said lobe being adjustable along the fixed jaw via a worm screw engaged with the gear rack, wherein the hook jaw comprises a first set of teeth associated with the outer engagement region and a second set of teeth associated with the inner engagement region.

7. The wrench of claim 6, further comprising a spring element positioned to bias the hook jaw toward the fixed jaw.

8. The wrench of claim 6, further comprising first indicia positioned proximate the fixed jaw on a first side of the wrench indicating lobe positions corresponding to selected sizes in the first range, and second indicia positioned proximate the fixed jaw on a second side of the wrench indicating lobe positions corresponding to selected sizes in the second range.

9. The wrench of claim 6, wherein the first set of teeth have a first pitch and the second set of teeth have a second pitch larger than the first.

10. The wrench of claim 6, wherein the first range of sizes corresponds to ⅛ to 1 inch pipe and the second range of sizes corresponds to 1 to 1½ inch pipe.

11. A dual-range wrench, comprising:

an elongate handle;

a fixed jaw carried by the handle, wherein the fixed jaw comprises multiple teeth disposed linearly along the jaw;

a hook jaw coupled to the handle with a pivot pin, wherein the hook jaw includes multiple teeth angled toward the pivot pin; and a lobe positioned adjacent the fixed jaw, wherein the lobe is positioned between an outer engagement region sized to engage a first range of sizes and an inner engagement region sized to engage a second range of sizes, said lobe comprising a multi-toothed semi-circular element disposed on a gear rack, said lobe being adjustable along the fixed jaw via a worm screw engaged with the gear rack; and first indicia positioned proximate the fixed jaw on a first side of the wrench indicating lobe positioned corresponding to selected sizes in the first range, and second indicia positioned proximate the fixed jaw on a second side of the wrench indicating lobe positions corresponding to selected sizes in the second range.

12. The wrench of claim 11, wherein the multiple hook jaw teeth comprise a first set of teeth associated with the outer engagement region and a second set of teeth associated with the inner engagement region.

13. The wrench of claim 12, wherein the first set of teeth have a first pitch and the second set of teeth have a second pitch larger than the first.

14. The wrench of claim 11, wherein the multiple fixed jaw teeth are angled away from the pivot pin.

15. The wrench of claim 11, further comprising a spring element positioned to bias the hook jaw toward the fixed jaw.

16. An adjustable dual-range wrench, comprising:

an elongate handle;

a fixed jaw carried by the handle, wherein the fixed jaw comprises multiple teeth disposed linearly along the jaw;

a lobe adjustable along the fixed jaw, wherein the lobe is positioned between an outer engagement region sized to engage a first range of sizes and an inner engagement region sized to engage a second range of sizes;

a hook jaw pivotably coupled to the handle, said hook jaw comprising a first set of teeth associated with the outer engagement region and a second set of teeth associated with the inner engagement region; and first indicia positioned proximate the fixed jaw on a first side of the wrench indicating lobe positions corresponding to selected sizes in the first range, and second indicia positioned proximate the fixed jaw on a second side of the wrench indicating lobe positions corresponding to selected sizes in the second range.

* * * * *